US012196443B2

(12) United States Patent
Zou

(10) Patent No.: US 12,196,443 B2
(45) Date of Patent: Jan. 14, 2025

(54) AIR CONDITIONER, HEATING CONTROL METHOD OF AIR CONDITIONER AND COMPUTER READABLE STORAGE MEDIUM

(71) Applicant: GD MIDEA AIR-CONDITIONING EQUIPMENT CO., LTD., Guangdong (CN)

(72) Inventor: Dashu Zou, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 294 days.

(21) Appl. No.: 17/749,351

(22) Filed: May 20, 2022

(65) Prior Publication Data

US 2022/0275964 A1 Sep. 1, 2022

Related U.S. Application Data

(63) Continuation of application No. PCT/CN2020/088767, filed on May 6, 2020.

(30) Foreign Application Priority Data

Dec. 9, 2019 (CN) ..... 201911262568.X

(51) Int. Cl.
*F24F 11/84* (2018.01)
*F24F 11/64* (2018.01)
(Continued)

(52) U.S. Cl.
CPC ..... *F24F 11/84* (2018.01); *F24F 11/64* (2018.01); *F25B 49/022* (2013.01);
(Continued)

(58) Field of Classification Search
CPC ..... F24F 11/84; F24F 11/64; F24F 2110/10; F24F 2140/20; F25B 49/022; F25B 41/34
See application file for complete search history.

(56) References Cited

U.S. PATENT DOCUMENTS

2011/0192176 A1 8/2011 Kim et al.

FOREIGN PATENT DOCUMENTS

CN 105928138 A 9/2016
CN 106931546 A 7/2017
(Continued)

OTHER PUBLICATIONS

First Office Action dated Aug. 25, 2020 received in Chinese Patent Application No. CN 201911262568.X together with an English language translation.

(Continued)

*Primary Examiner* — Nael N Babaa
(74) *Attorney, Agent, or Firm* — Scully, Scott, Murphy & Presser, P.C.

(57) ABSTRACT

An air conditioner, a heating control method of an air conditioner, and a computer readable storage medium are provided. According to the method, a refrigerant passing through an evaporator is divided by a shunting module into two flows; one flow of the refrigerant is throttled and depressurized by an enhanced vapor injection electronic expansion valve. Based on a difference between an indoor pipe temperature and an exhaust temperature of a compressor of the air conditioner, an opening degree parameter of the enhanced vapor injection electronic expansion valve is controlled to control a refrigerant output amount by the enhanced vapor injection electronic expansion valve. Thus, the refrigerant amount of the flow of refrigerant, subject to throttling and depressurizing, for exchanging heat with the (Continued)

other flow of refrigerant can be controlled to implement an enhanced vapor injection function.

10 Claims, 4 Drawing Sheets

(51) Int. Cl.

| | |
|---|---|
| ***F25B 49/02*** | (2006.01) |
| *F24F 110/10* | (2018.01) |
| *F24F 140/20* | (2018.01) |
| *F25B 41/34* | (2021.01) |

(52) U.S. Cl.
CPC ..... *F24F 2110/10* (2018.01); *F24F 2140/20* (2018.01); *F25B 41/34* (2021.01)

(56) References Cited

FOREIGN PATENT DOCUMENTS

| | | | |
|---|---|---|---|
| CN | 109237748 | A | 1/2019 |
| CN | 109373533 | A | 2/2019 |
| CN | 110925975 | A | 3/2020 |
| JP | 2018204898 | A | 12/2018 |

OTHER PUBLICATIONS

Second Office Action dated Mar. 31, 2021 received in Chinese Patent Application No. CN 201911262568.X together with an English language translation.

AIR CONDITIONER, HEATING CONTROL METHOD OF AIR CONDITIONER AND COMPUTER READABLE STORAGE MEDIUM

CROSS-REFERENCE TO RELATED APPLICATIONS

This application is a continuation application of PCT International Patent Application No. PCT/CN2020/088767, filed on May 6, 2020, which claims priority to and benefits of Chinese Patent Application No. 201911262568.X, filed on Dec. 9, 2019, the entire contents of which are incorporated herein by reference for all purposes. No new matter has been introduced.

FIELD

This application relates to the field of air conditioners, and in particular, to an air conditioner, a heating control method of an air conditioner and a computer readable storage medium.

BACKGROUND

In a low temperature environment, such as −15° C., −20° C. or even lower, a large amount of heat is required to be output in regions such as the United States and Canada. At present, the air conditioning system improves the heating through operating at a high frequency in the low temperature environment, but this will cause low pressure, the output heat is limited, and the requirements of users cannot be met. In addition, when operating at the high-frequency, the noise generated by the air conditioner is increased, and the user experience is reduced.

SUMMARY

The main purpose of the present application is to provide an air conditioner, a heating control method of an air conditioner and a computer readable storage medium, aiming to solve the technical problem that the current air conditioner outputs less heat when operating at a high frequency in a low-temperature environment, and meanwhile the noise of the air conditioner is large.

In order to achieve the purpose, the heating control method of the air conditioner is applied to a heating control system of the air conditioner, and the heating control system includes a shunting module and an enhanced vapor injection electronic expansion valve to divide refrigerant passing through an evaporator into two flows through the shunting module, the heating control method of the air conditioner including:

acquiring a current indoor temperature, and calculating a first difference between the current indoor temperature and a preset temperature;

when the first difference is greater than a first temperature threshold, acquiring an indoor pipe temperature of the evaporator and an exhaust temperature of a compressor, and calculating a second difference between the indoor pipe temperature and the exhaust temperature;

determining an opening degree parameter of the enhanced vapor injection electronic expansion valve based on the second difference, to control a refrigerant output amount by the enhanced vapor injection electronic expansion valve, and throttling and depressurizing one flow of refrigerant through the enhanced vapor injection electronic expansion valve; and carrying out heat exchange between the flow of refrigerant throttled and depressurized and another flow of refrigerant to generate heat, thereby increasing a heating amount of the air conditioner.

In an embodiment, the determining an opening degree parameter of the enhanced vapor injection electronic expansion valve based on the second difference, to control a refrigerant output amount by the enhanced vapor injection electronic expansion valve, and throttling and depressurizing one flow of refrigerant through the enhanced vapor injection electronic expansion valve includes:

determining whether the second difference is not less than a first threshold; and if the second difference is not less than the first threshold, increasing the opening degree parameter of the enhanced vapor injection electronic expansion valve to increase the refrigerant output amount by the enhanced vapor injection electronic expansion valve, and throttling and depressurizing the flow of refrigerant through the enhanced vapor injection electronic expansion valve.

In an embodiment, the increasing the opening degree parameter of the enhanced vapor injection electronic expansion valve includes:

according to a preset time interval, controlling the opening degree parameter of the enhanced vapor injection electronic expansion valve to increase a fixed value each time and increase to a maximum opening degree parameter.

In an embodiment, the determining whether the second difference is not less than a first threshold includes:

if the second difference is less than the first threshold, determining whether the second difference is less than a second threshold which is less than the first threshold; and if the second difference is less than the second threshold, reducing the opening degree parameter of the enhanced vapor injection electronic expansion valve, to decrease the refrigerant output amount by the enhanced vapor injection electronic expansion valve, and throttling and depressurizing the output flow of refrigerant through the enhanced vapor injection electronic expansion valve.

In an embodiment, after the if the second difference is less than the first threshold, determining whether the second difference is less than a second threshold which is less than the first threshold, the method further includes:

if the second difference is less than the first threshold but not less than the second threshold, controlling the enhanced vapor injection electronic expansion valve to maintain a current opening degree parameter, to maintain a current refrigerant output amount by the enhanced vapor injection electronic expansion valve, and throttling and depressurizing the output flow of refrigerant through the enhanced vapor injection electronic expansion valve.

In an embodiment, after the acquiring a current indoor temperature, and calculating a first difference between the current indoor temperature and a preset temperature, the method further includes:

when the first difference is not greater than the first temperature threshold and not less than a second temperature threshold, determining whether the second difference is not less than the first threshold, wherein the second temperature threshold is less than the first temperature threshold; and if the second difference is not less than the first threshold, controlling the enhanced vapor injection electronic expansion valve to maintain a current opening degree parameter, to maintain a current refrigerant output amount by the enhanced vapor injection electronic expansion valve, and throttling and depressurizing the flow of refrigerant through the enhanced vapor injection electronic expansion valve.

In an embodiment, after the when the first difference is not greater than the first temperature threshold and not less than a second temperature threshold, determining whether the second difference is not less than the first threshold, wherein the second temperature threshold is less than the first temperature threshold, the method further includes:

if the second difference is less than both the first threshold and the second threshold which is less than the first threshold, reducing the opening degree parameter of the enhanced vapor injection electronic expansion valve, to reduce the refrigerant output amount by the enhanced vapor injection electronic expansion valve, and throttling and depressurizing the output flow of refrigerant through the enhanced vapor injection electronic expansion valve; and if the second difference is less than the first threshold but not less than the second threshold, controlling the enhanced vapor injection electronic expansion valve to maintain the current opening degree parameter, to maintain the current refrigerant output amount by the enhanced vapor injection electronic expansion valve, and throttling and depressurizing the output flow of refrigerant through the enhanced vapor injection electronic expansion valve.

In an embodiment, after the acquiring a current indoor temperature, and calculating a first difference between the current indoor temperature and a preset temperature, the method further includes:

when the first difference is less than the second temperature threshold and greater than a third temperature threshold, closing the enhanced vapor injection electronic expansion valve, and reducing a working frequency of the compressor.

In order to achieve the above purpose, the present application further provides an air conditioner. The air conditioner includes a shunting module, an enhanced vapor injection electronic expansion valve, a memory, a processor, and a heating control program for the air conditioner stored in the memory and executable by the processor, so as to divide refrigerant passing through the evaporator into two flows through the shunting module, when the heating control program of the air conditioner is executed by the processor, operations of the heating control method of the air conditioner mentioned above are realized In order to achieve the purpose, the present application further provides a computer readable storage medium, the computer readable storage medium includes a heating control program of an air conditioner, when the heating control program of the air conditioner is executed by a processor, the heating control method of the air conditioner mentioned above is implemented.

According to the air conditioner, the heating control method of the air conditioner and the computer readable storage medium provided by the present application, the heating control method of the air conditioner is applied to the heating control system of the air conditioner, and the heating control system includes a shunting module and an enhanced vapor injection electronic expansion valve, so as to divide the refrigerant passing through the evaporator into two flows through the shunting module; and the heating control method of the air conditioner obtains the current indoor temperature, and calculates a first difference between the current indoor temperature and a preset temperature; acquires the indoor pipe temperature of the evaporator and the exhaust temperature of the compressor when the first difference is greater than a first temperature threshold, and calculates a second difference between the indoor pipe temperature and the exhaust temperature; and determines the opening degree parameter of the enhanced vapor injection electronic expansion valve based on the second difference, so as to control the refrigerant output amount by the enhanced vapor injection electronic expansion valve, and throttles and depressurizes the output flow of refrigerant through the enhanced vapor injection electronic expansion valve; and carries out heat exchange between the flow of refrigerant throttled and depressurized and another flow of refrigerant to generate heat, so as to increase the heating amount of the air conditioner. By this way, the refrigerant passing through the evaporator is divided into two flows through the shunting module, one flow of refrigerant is subject to throttling and pressure reduction through the enhanced vapor injection electronic expansion valve, and then the opening degree parameter of the enhanced vapor injection electronic expansion valve is controlled based on the difference between the indoor pipe temperature and the exhaust temperature of the compressor, so that the refrigerant output amount by the enhanced vapor injection electronic expansion valve is controlled, and then the refrigerant amount of the flow of refrigerant subject to throttling and depressurizing is controlled, thus the refrigerant amount of the flow of refrigerant throttled and depressurized for exchanging heat with the another flow of refrigerant is controlled, thereby the enhanced vapor injection effect is achieved, the heating of the air conditioner is improved, the noise during high-frequency operation of the air conditioner is reduced, and the user experience is improved.

The realization of the objectives, functional features and advantages of the present application will be further explained with reference to the accompanying drawings in combination with the embodiment.

DETAILED DESCRIPTION OF THE EMBODIMENTS

It should be understood that the specific embodiments described herein are only used to explain the present application, and are not intended to limit the present application.

The main solution of certain embodiment of the present application is that a heating control method of an air conditioner is applied to a heating control system of the air conditioner. The heating control system includes a shunting module and an enhanced vapor injection electronic expansion valve, so that the refrigerant passing through an evaporator is divided into two flows by the shunting module. The enhanced vapor injection electronic expansion valve can be an air-injection enthalpy-increasing electronic expansion valve. A current indoor temperature is obtained and a first difference between the current indoor temperature and a preset temperature is calculated. When the first difference is greater than a first temperature threshold, an indoor pipe temperature of the evaporator and an exhaust temperature of a compressor are obtained, and a second difference between the indoor pipe temperature and the exhaust temperature is calculated, an opening degree parameter of the enhanced vapor injection electronic expansion valve is determined based on the second difference, so as to control the refrigerant output by the enhanced vapor injection electronic expansion valve. One flow of the refrigerant is throttled and depressurized by the enhanced vapor injection electronic expansion valve, and exchanges heat with another flow of the refrigerant to generate heat, so as to increase the heating amount of the air conditioner. The shunting module divides the refrigerant passing through the evaporator into two flows, and one flow is throttled and depressurized by the enhanced vapor injection electronic expansion valve. The opening degree parameter of the enhanced vapor injection electronic expansion valve is controlled based on the difference value between the indoor pipe temperature and the exhaust temperature of the compressor, thereby controlling the refrigerant output by the enhanced vapor injection electronic expansion valve, controlling the refrigerant amount of the flow subject to throttling and pressure reduction and the refrigerant amount of the flow throttled and depressurized for exchanging heat with the other flow, realizing the enhanced vapor injection effect, improving the heating of the air conditioner, and reducing the noise during high-frequency operation of the air conditioner. Thus, the user experience is improved.

Figure 1:
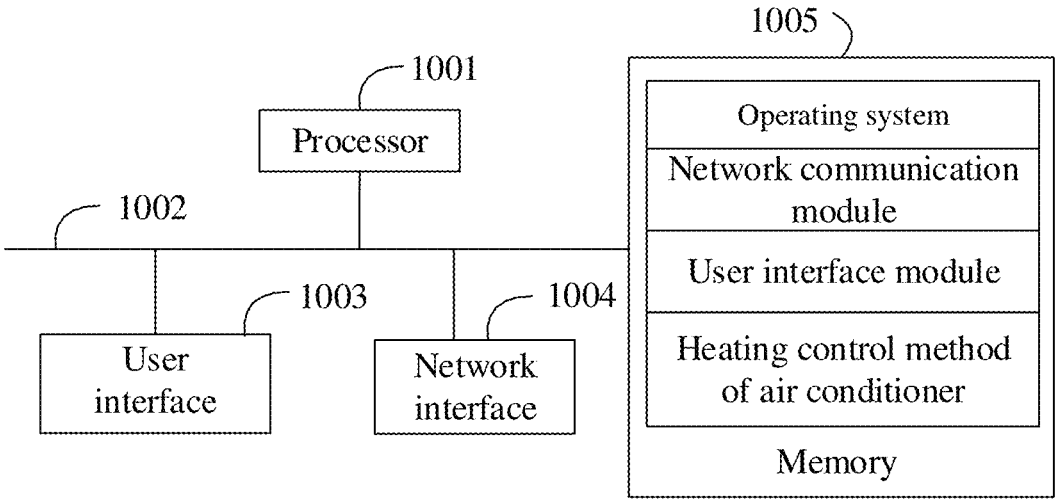
FIG. 1 is a schematic diagram of hardware structures of an air conditioner according to an embodiment of the present application.

As an implementation, the air conditioner can be shown as FIG. 1.

An embodiment of the present application relates to an air conditioner, and the air conditioner includes: a processor 1001 (e.g., a CPU), a communication bus 1002, a user interface 1003, a network interface 1004, and a memory 1005. The communication bus 1002 is configured for realizing connection and communication between those components.

The memory 1005 may be a high-speed RAM memory or a non-volatile memory, such as a magnetic disk memory. As shown in FIG. 1, the memory 1005, as a computer readable storage medium, may include a heating control program of an air conditioner, and the processor 1001 may be configured for invoking the heating control program of the air conditioner stored in the memory 1005, and performing following operations:

acquiring a current indoor temperature, and calculating a first difference between the current indoor temperature and a preset temperature;

when the first difference is greater than a first temperature threshold, acquiring an indoor pipe temperature of an evaporator and an exhaust temperature of a compressor, and calculating a second difference between the indoor pipe temperature and the exhaust temperature;

determining an opening degree parameter of the enhanced vapor injection electronic expansion valve based on the second difference, to control a refrigerant output amount by the enhanced vapor injection electronic expansion valve, and throttling and depressurizing one flow of refrigerant through the enhanced vapor injection electronic expansion valve; and carrying out heat exchange between the flow of refrigerant throttled and depressurized and another flow of refrigerant to generate heat, thereby increasing a heating amount of the air conditioner.

In one embodiment, the processor 1001 may be configured to invoke the heating control program of the air conditioner stored in the memory 1005, and perform following operations:

determining whether the second difference is not less than a first threshold; and if the second difference is not less than the first threshold, increasing the opening degree parameter of the enhanced vapor injection electronic expansion valve to increase the refrigerant output amount by the enhanced vapor injection electronic expansion valve, and throttling and depressurizing the output flow of refrigerant through the enhanced vapor injection electronic expansion valve.

In one embodiment, the processor 1001 may be configured to invoke the heating control program of the air conditioner stored in the memory 1005, and perform following operations:

according to a preset time interval, controlling the opening degree parameter of the enhanced vapor injection electronic expansion valve to increase a fixed value each time and increase to a maximum opening degree parameter.

In one embodiment, the processor 1001 may be configured to invoke the heating control program of the air conditioner stored in the memory 1005, and perform following operations:

if the second difference is less than the first threshold, determining whether the second difference is less than a second threshold which is less than the first threshold; and if the second difference is less than the second threshold, reducing the opening degree parameter of the enhanced vapor injection electronic expansion valve, to decrease the refrigerant output amount by the enhanced vapor injection electronic expansion valve, and throttling and depressurizing the output flow of refrigerant through the enhanced vapor injection electronic expansion valve.

In one embodiment, the processor 1001 may be configured to invoke the heating control program of the air conditioner stored in the memory 1005, and perform following operations:

if the second difference is less than the first threshold but not less than the second threshold, controlling the enhanced vapor injection electronic expansion valve to maintain a current opening degree parameter, to maintain a current refrigerant output amount by the enhanced vapor injection electronic expansion valve, and throttling and depressurizing the output flow of refrigerant through the enhanced vapor injection electronic expansion valve.

In one embodiment, the processor 1001 may be configured to invoke the heating control program of the air conditioner stored in the memory 1005, and perform following operations:

when the first difference is not greater than the first temperature threshold and not less than a second temperature threshold, determining whether the second difference is not less than the first threshold, where the second temperature threshold is less than the first temperature threshold; and if the second difference is not less than the first threshold, controlling the enhanced vapor injection electronic expansion valve to maintain the current opening degree parameter, to maintain the current refrigerant output amount by the enhanced vapor injection electronic expansion valve, and throttling and depressurizing the output flow of refrigerant through the enhanced vapor injection electronic expansion valve.

In one embodiment, the processor 1001 may be configured to invoke the heating control program of the air conditioner stored in the memory 1005, and perform following operations:

if the second difference is less than both the first threshold and the second threshold which is less than the first threshold, reducing the opening degree parameter of the enhanced vapor injection electronic expansion valve, to reduce the refrigerant output amount by the enhanced vapor injection electronic expansion valve, and throttling and depressurizing the output flow of refrigerant through the enhanced vapor injection electronic expansion valve; and if the second difference is less than the first threshold but not less than the second threshold, controlling the enhanced vapor injection electronic expansion valve to maintain the current opening degree parameter, to maintain the current refrigerant output amount by the enhanced vapor injection electronic expansion valve, and throttling and depressurizing the output flow of refrigerant through the enhanced vapor injection electronic expansion valve.

In one embodiment, the processor 1001 may be configured to invoke the heating control program of the air conditioner stored in the memory 1005, and perform following operations:

when the first difference is less than the second temperature threshold and greater than a third temperature threshold, closing the enhanced vapor injection electronic expansion valve, and reducing a working frequency of the compressor.

According to the above solution, the shunting module divides the refrigerant passing through the evaporator into two flows, one flow is throttled and depressurized by the enhanced vapor injection electronic expansion valve, and the opening degree parameter of the enhanced vapor injection electronic expansion valve is controlled based on the difference between the indoor pipe temperature and the exhaust temperature of the compressor, thereby controlling the refrigerant output by the enhanced vapor injection electronic expansion valve, controlling the refrigerant amount of the flow subject to throttling and pressure reduction and controlling the refrigerant amount of the flow throttled and depressurized for exchanging heat with the other flow, realizing the enhanced vapor injection effect, improving the heating of the air conditioner, and reducing the noise during high-frequency operation of the air conditioner. Thus, the user experience is improved.

Based on the above hardware structure, the embodiments of a heating control method of an air conditioner of the present application is provided.

Figure 2:
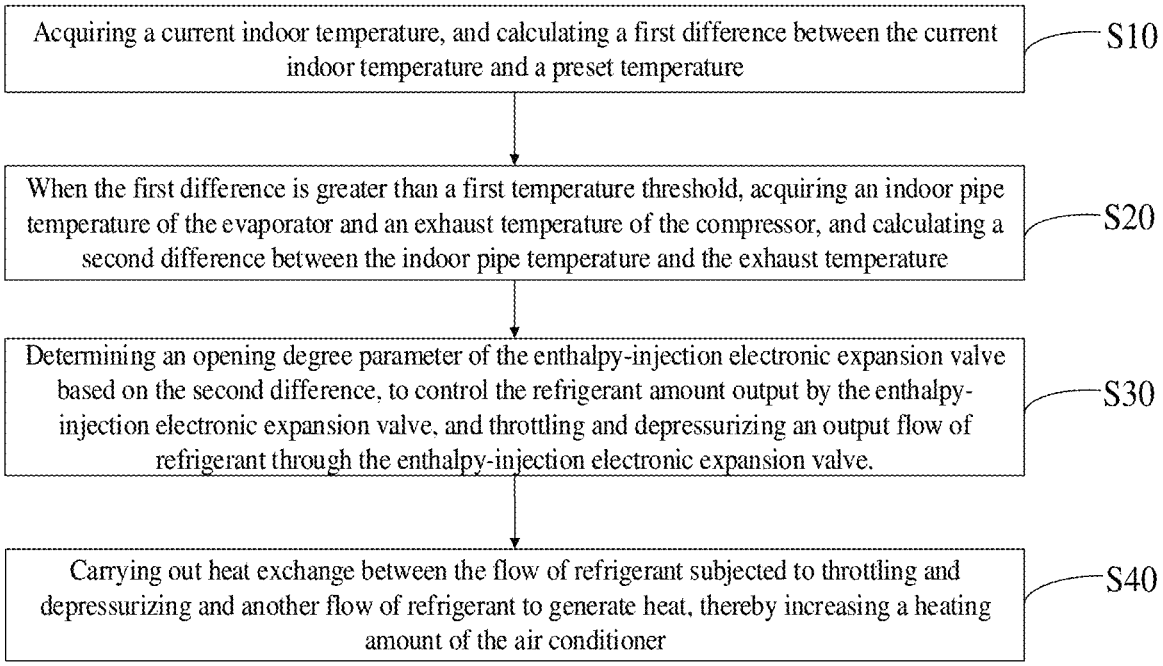
FIG. 2 is a schematic flowchart of a heating control method for an air conditioner according to a first embodiment of the present application.

Referring to FIG. 2, FIG. 2 is a first embodiment of the heating control method of the air conditioner of the present application, the heating control method of the air conditioner is applied to a heating control system of the air conditioner, and the heating control system includes a shunting module and an enhanced vapor injection electronic expansion valve, so as to divide refrigerant passing through an evaporator into two flows through the shunting module. The heating control method of the air conditioner includes following operations:

operation S10, acquiring a current indoor temperature, and calculating a first difference between the current indoor temperature and a preset temperature.

Figure 3:
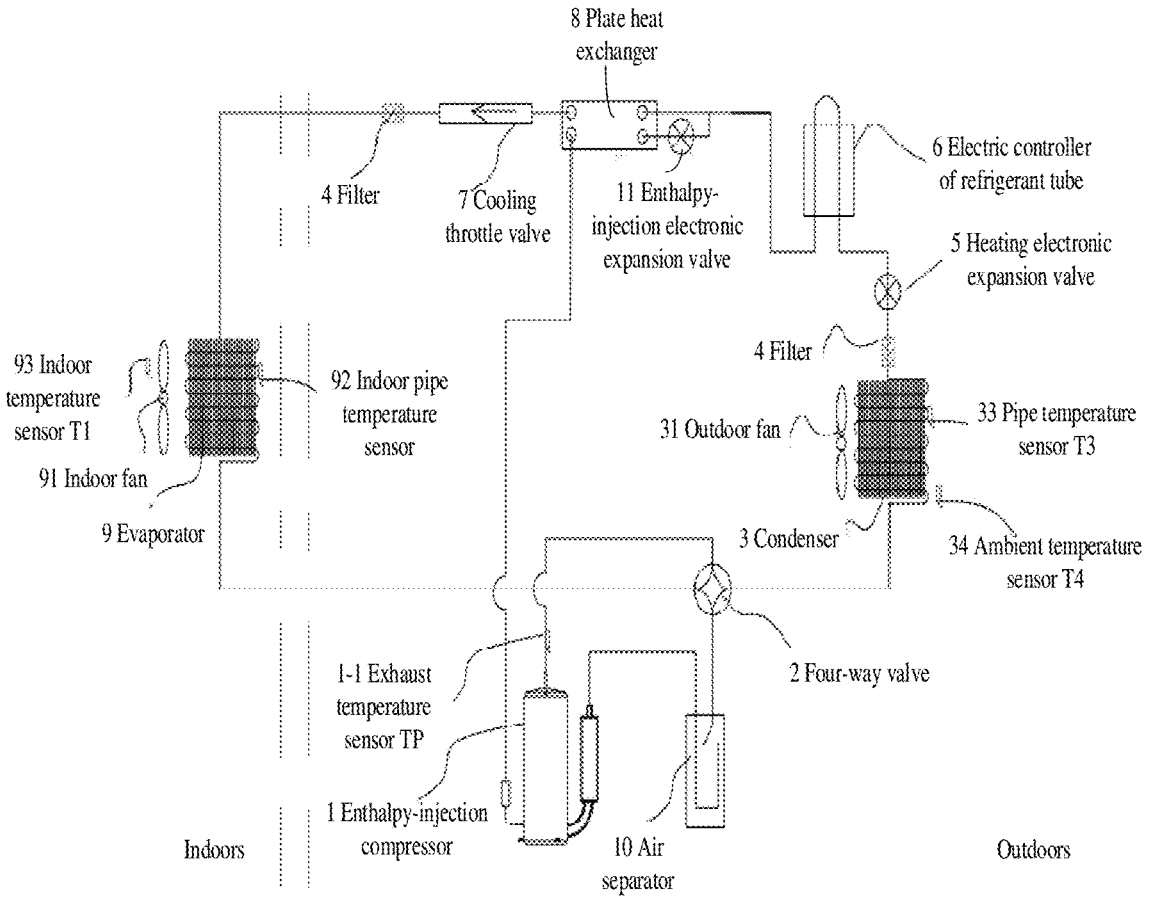
FIG. 3 is a schematic diagram of a working principle of the air conditioner according to the present application.

In the present application, an air conditioner is used for implementing the method. A principle diagram of the air conditioner is shown in FIG. 3. 1 represents an enhanced vapor injection compressor (such as, an air-injection enthalpy-increasing compressor) or another inverter compressor, 1-1 represents an exhaust temperature sensor TP, 2 represents a four-way valve, 3 represents a condenser, 31 represents an upper fan, 32 represents a lower fan, 33 represents a pipe temperature sensor T3, 34 represents an ambient temperature sensor T4, 4 represents a filter, 5 represents a heating electronic expansion valve, 6 represents an electric controller of a refrigerant tube, 7 represents a cooling throttle valve, 8 represents a plate heat exchanger or a shunting heat exchanger, 9 represents an evaporator, 91 represents an internal fan, 92 represents an indoor pipe temperature sensor T2, 93 represents an indoor temperature sensor T1, 10 represents an air-liquid separator, and 11 represents an enhanced vapor injection electronic expansion valve. When the air conditioner is in an cooling operation, the high-temperature and high-pressure gas refrigerant discharged by the enhanced vapor injection compressor 1 flows through the four-way valve 2, enters the condenser 3 for heat dissipation, passes through the filter 4, the heating electronic expansion valve 5, and the electric controller 6 of the refrigerant tube to realize cooling of the heating components of the electric controller, flows through the main path of the plate heat exchanger 8 and is throttled by the cooling throttle valve 7 to generate the low-temperature low-pressure refrigerant. The refrigerant enters the indoor side evaporator 9 for absorbing heat and evaporating, and then flows into the gas-liquid separator 10 for gas-liquid separation. The gaseous refrigerant returns to the compressor for circulation, and the liquid refrigerant is stored in the gas-liquid separator 10. When the air conditioner is heating, the high-temperature and high-pressure gas refrigerant discharged by the enhanced vapor injection compressor 1 flows through the four-way valve 2 and enters the evaporator 9 for heat dissipation, then flows through the filter 4, the cooling throttle valve 7, the main path of the plate heat exchanger 8 and the electric controller 6 of the refrigerant tube to cool the heating components of the electric controller, and then is throttled by the heating electronic expansion valve 5 to generate the low-temperature low-pressure refrigerant. The refrigerant enters the outdoor side condenser 3 for absorbing heat and evaporating, and then flows into the gas-liquid separator 10 for gas-liquid separation. The gaseous refrigerant returns to the compressor for circulation, and the liquid refrigerant is stored in the gas-liquid separator 10. When the enhanced vapor injection electronic expansion valve 11 is opened, the refrigerant in the main path flows through the plate heat exchanger 8 and is divided into two flows. One flow flows through the electric controller 6 of the refrigerant tube and enters the condenser 3 to absorb heat, and then returns to the enhanced vapor injection compressor 1 to be compressed and recycle. The other flow passes through the auxiliary path, and is subject to throttling and pressure reduction through the enhanced vapor injection electronic expansion valve 11, and then exchanges heat with the refrigerant in the main path to generate the medium-temperature medium-pressure refrigerant, and returns to the enhanced vapor injection compressor 1. Thus, the enhanced vapor injection effect is realized, the heating is greatly improved, and the user experience is improved. The opening degree parameter of the enhanced vapor injection electronic expansion valve 11 affects the refrigerant output amount by the enhanced vapor injection electronic expansion valve 11, thereby affecting the heat exchange between the auxiliary path and the main path. Whether a large amount of heating is needed indoors is determined by monitoring a difference between an indoor temperature and a preset temperature threshold. Whether the refrigerant output amount by the enhanced vapor injection electronic expansion valve 11 is suitable is determined by monitoring a difference between an exhaust temperature of an exhaust port of the enhanced vapor injection compressor 1 and an indoor pipe temperature. If the refrigerant amount is insufficient, the generated heat is insufficient. If the refrigerant amount is too large, the liquid hammer problem easily occurs, and heating is reduced. Specifically, the air conditioner is started to heat, and operates with initial operating parameters for a preset time, the current indoor temperature T1 is detected by the indoor temperature sensor 93, and the difference between T1 and the preset temperature threshold TS is calculated. The preset temperature threshold TS can be set according to the heat actual required.

Operation S20, when the first difference is greater than a first temperature threshold, acquiring an indoor pipe temperature of the evaporator 9 and an exhaust temperature of the compressor 1, and calculating a second difference between the indoor pipe temperature and the exhaust temperature.

In the embodiment, if the first difference is greater than the first temperature threshold, such as four, that is, the difference between the indoor temperature and the set temperature is large, the large heating output is needed. Then the heating pipe temperature T2 is detected by the indoor pipe temperature sensor 92, and the temperature TP of the exhaust port of the enhanced vapor injection compressor 1 is detected by the exhaust temperature sensor 1-1, and the second difference between T2 and TP is calculated.

Operation S30, determining an opening degree parameter of the enhanced vapor injection electronic expansion valve 11 based on the second difference, to control the refrigerant output amount by the enhanced vapor injection electronic expansion valve 11, and throttling and depressurizing an output flow of refrigerant through the enhanced vapor injection electronic expansion valve 11.

In this embodiment, the second difference is compared with the first threshold and the second threshold, so as to determine whether the heat of heat exchanging meets the requirement based on the temperature difference between the exhaust port and the indoor pipe, thereby determining whether the refrigerant amount in the auxiliary path meets the requirement, and whether the opening degree parameter of the enhanced vapor injection electronic expansion valve 11 for output refrigerant is suitable.

Operation S40, carrying out heat exchange between the flow of refrigerant subject to throttling and depressurizing and another flow of refrigerant to generate heat, thereby increasing a heating amount of the air conditioner.

In the present embodiment, when the enhanced vapor injection electronic expansion valve 11 is opened, the refrigerant in the main path is divided into two flows by the plate heat exchanger 8, one flow of refrigerant passes the electric controller 6 of the refrigerant tube, then enters the condenser 3 to absorb heat, and then returns to the enhanced vapor injection compressor 1 for compression and circulation. The other flow passes through the auxiliary path, and is subject to throttling and depressurizing through the enhanced vapor injection electronic expansion valve 11, and then exchanges heat with the refrigerant in the main path to generate the medium-temperature medium-pressure refrigerant, and returns to the enhanced vapor injection compressor 1, so that the enhanced vapor injection effect is realized, the heating is greatly improved.

In the technical solution provided in this embodiment, the refrigerant passing through the evaporator is divided into two flows by a shunting module, and one flow is throttled and depressurized by the enhanced vapor injection electronic expansion valve 11, and then the opening degree parameter of the enhanced vapor injection electronic expansion valve 11 is controlled according to the difference between the indoor pipe temperature and the exhaust temperature of the compressor, thereby controlling the refrigerant output amount by the enhanced vapor injection electronic expansion valve 11, controlling the refrigerant amount of the flow subject to throttling and pressure reduction and the refrigerant amount of the flow subject to throttling and pressure reduction for exchanging heat with the other flow, realizing the enhanced vapor injection effect, improving the heating of the air conditioner, reducing the noise during high-frequency operation of the air conditioner, and improving the user experience.

Figure 4:
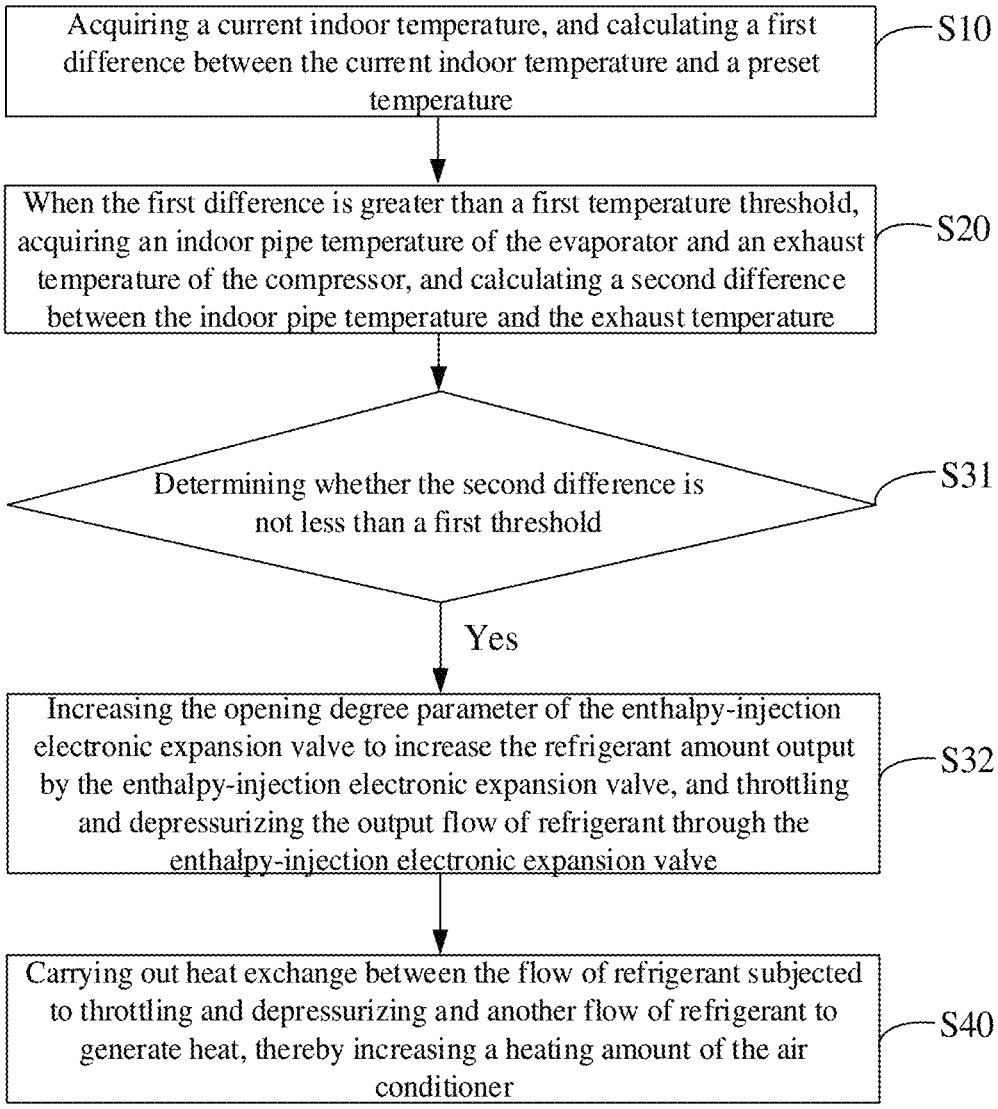
FIG. 4 is a flowchart of the heating control method for the air conditioner according to a second embodiment of the present application.

Referring to FIG. 4, FIG. 4 is a second embodiment of the heating control method of the air conditioner of the present application. Based on the first embodiment, operation S30 includes:

operation S31, determining whether the second difference is not less than a first threshold;

operation S32, if the second difference is not less than the first threshold, increasing the opening degree parameter of the enhanced vapor injection electronic expansion valve to increase the refrigerant output amount by the enhanced vapor injection electronic expansion valve, and throttling and depressurizing the output flow of refrigerant through the enhanced vapor injection electronic expansion valve.

In this embodiment, it is determined whether the second difference is not less than a first threshold, for example, whether TP minus T2 is not less than ten is judged. When TP minus T2 is not less than ten, the current refrigerant amount is insufficient, and the opening of the enhanced vapor injection electronic expansion valve 11 is increased, thereby increasing the refrigerant output amount by the enhanced vapor injection electronic expansion valve 11.

It should be noted that the step of increasing the opening degree parameter of the enhanced vapor injection electronic expansion valve 11 includes: controlling the opening degree parameter of the enhanced vapor injection electronic expansion valve 11 according to a preset time interval, and increasing the opening degree parameter of the enhanced vapor injection electronic expansion valve 11 to a maximum opening degree parameter through increasing a fixed value each time. For example, starting from an initial opening degree parameter P, the opening degree parameter of the enhanced vapor injection electronic expansion valve 11 is increased for five steps every 30 s, and a range of the opening degree is from 60 to 480.

In one embodiment, after the step S31, the method further includes: if the second difference is less than the first threshold but not less than the second threshold, controlling the enhanced vapor injection electronic expansion valve 11 to maintain a current opening degree parameter so as to maintain the refrigerant amount currently output by the enhanced vapor injection electronic expansion valve 11, and throttling and depressurizing the output flow of refrigerant through the enhanced vapor injection electronic expansion valve 11.

In this embodiment, if the second difference is less than the first threshold but not less than the second threshold, for example, TP minus T2 is less than ten but not less than five, that is, the refrigerant amount of the current heat exchange meets the requirement, that is, the opening degree parameter of the enhanced vapor injection electronic expansion valve 11 is appropriate. The enhanced vapor injection electronic expansion valve 11 can be controlled to maintain the current opening degree parameter so as to maintain the current refrigerant output amount by the enhanced vapor injection electronic expansion valve 11, that is, the enhanced vapor injection compressor 1 is controlled to operate at a preset frequency F, and the enhanced vapor injection electronic expansion valve 11 is controlled to operate with the current opening degree.

According to the technical solution provided by this embodiment, the opening degree parameter of the enhanced vapor injection electronic expansion valve 11 is controlled based on the difference between the indoor pipe temperature and the exhaust temperature of the compressor, so that the refrigerant output amount by the enhanced vapor injection electronic expansion valve 11 is controlled, and then the refrigerant amount of the flow subject to throttling and pressure reduction is controlled, thereby the enhanced vapor injection effect is achieved, the heating of the air conditioner is improved, the noise during high-frequency operation of the air conditioner is reduced, and the user experience is improved.

Figure 5:
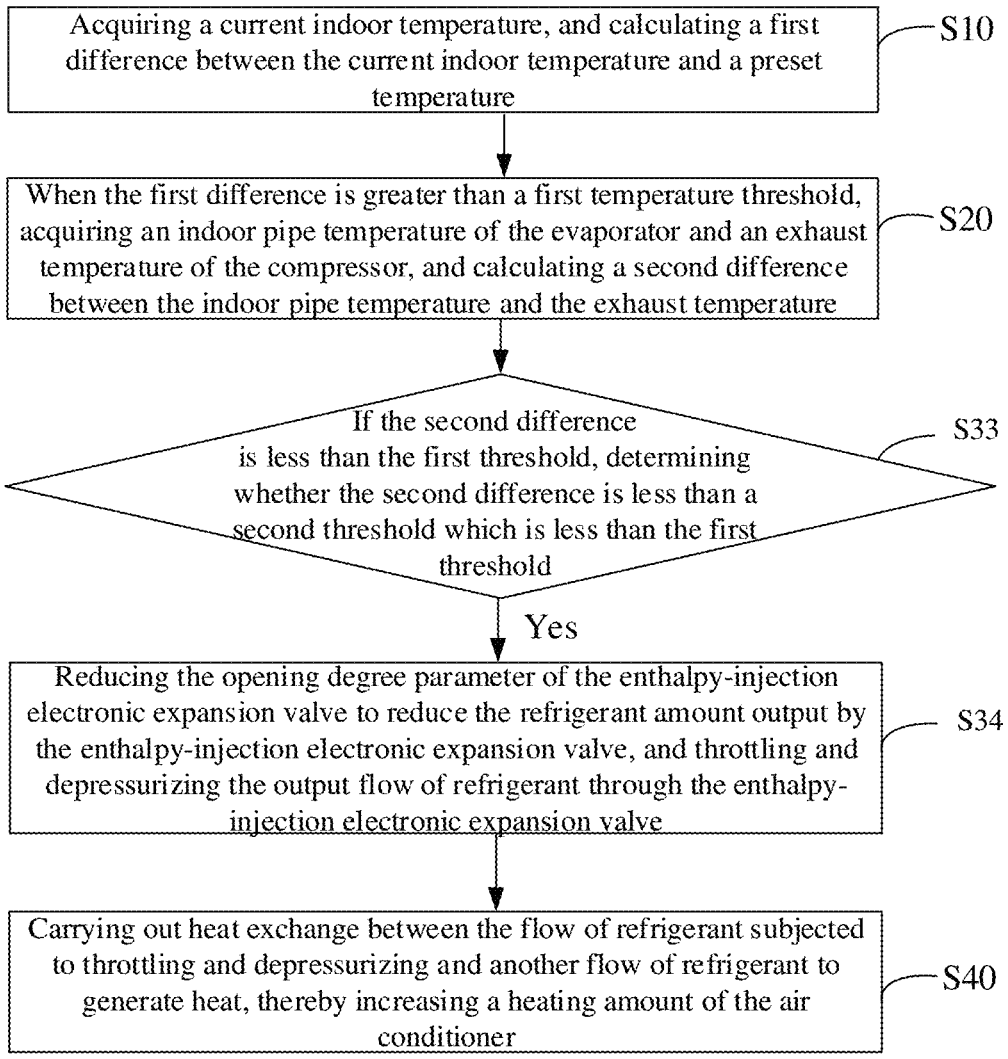
FIG. 5 is a flowchart of the heating control method for the air conditioner according to a third embodiment of the present application.

Referring to FIG. 5, FIG. 5 is a third embodiment of the heating control method of the air conditioner according to the present application. Based on the first embodiment, after operation S31, the method further includes:

operation S33, if the second difference is less than the first threshold, determining whether the second difference is less than a second threshold which is less than the first threshold;

operation S34, if the second difference is less than the second threshold, reducing the opening degree parameter of the enhanced vapor injection electronic expansion valve 11, to decrease the refrigerant output amount by the enhanced vapor injection electronic expansion valve 11, and throttling and depressurizing the output flow through the enhanced vapor injection electronic expansion valve 11.

In this embodiment, if the second difference is less than the first threshold, whether the second difference is less than a second threshold is further determined, the first threshold is greater than the second threshold. That is, whether TP minus T2 is less than 5 is determined, and when TP minus T2 is less than 5, the opening degree parameter of the enhanced vapor injection electronic expansion valve 11 is reduced, so as to reduce the refrigerant output amount by the enhanced vapor injection electronic expansion valve 11, for example, the enhanced vapor injection compressor 1 is controlled to operate at the preset frequency F, the opening degree of the enhanced vapor injection electronic expansion valve 11 is reduced by 10 degrees per 20 s, and then the value of TP minus T2 is checked after every 3 min.

In an embodiment, after operation S10, the method further includes: determining whether the second difference is not less than a first threshold when the first difference is not greater than the first temperature threshold and not less than a second temperature threshold, where the second temperature threshold is less than the first temperature threshold; if the second difference is not less than the first threshold, controlling the enhanced vapor injection electronic expansion valve 11 to maintain the current opening degree parameter so as to maintain the current refrigerant output amount by the enhanced vapor injection electronic expansion valve 11, and throttling and depressurizing the output flow through the enhanced vapor injection electronic expansion valve 11; if the second difference is less than both the first threshold and the second threshold less than the first threshold, reducing the opening degree parameter of the enhanced vapor injection electronic expansion valve 11, so as to reduce the refrigerant output amount by the enhanced vapor injection electronic expansion valve 11, and perform throttling and pressure reduction on the output flow through the enhanced vapor injection electronic expansion valve 11; if the second difference is less than the first threshold but not less than the second threshold, controlling the enhanced vapor injection electronic expansion valve 11 to maintain the current opening degree parameter, so as to maintain the current refrigerant output amount by the enhanced vapor injection electronic expansion valve 11, and throttling and depressurizing the output flow through the enhanced vapor injection electronic expansion valve 11.

In the present embodiment, when the first difference is not greater than the first temperature threshold and not less than the second temperature threshold less than the first temperature threshold, for example, Ts minus T1 is not greater than four and not less than one, that is, the indoor temperature and the set temperature difference are moderate, and the required heating output is moderate. Whether the second difference is not less than a first threshold is further determined, that is, whether TP minus T2 is not less than 10 is determined. When TP minus T2 is not less than 10, the enhanced vapor injection compressor 1 is controlled to operate at the preset frequency F, and the enhanced vapor injection electronic expansion valve 11 operates with an initial opening degree parameter P. When TP minus T2 is not less than five and less than ten, the enhanced vapor injection compressor 1 is controlled to operate at the preset frequency F, and the enhanced vapor injection electronic expansion valve 11 is controlled to operate with the initial opening degree parameter P. When TP minus T2 is less than 5, the enhanced vapor injection compressor 1 is controlled to operate at the preset frequency F, the enhanced vapor injection electronic expansion valve 11 is closed, and then the value of TP minus T2 is checked after every 3 min.

In an embodiment, after operation S10, the method further includes: closing the enhanced vapor injection electronic expansion valve 11 when the first difference is less than the second temperature threshold and greater than a third temperature threshold, and reducing a working frequency of the enhanced vapor injection compressor 1.

In this embodiment, when the first difference is less than the second temperature threshold and greater than the third temperature threshold, for example, Ts minus T1 is greater than −1 and less than 1, that is, the indoor temperature is close to the set temperature, and basically reaches the set value set by the user, and the required heating output is small, the enhanced vapor injection electronic expansion valve 11 is closed, and the compression frequency of the enhanced vapor injection compressor 1 is controlled to reduce from the initial value F to the lowest frequency F0.

The present application further provides an air conditioner. The air conditioner includes a shunting module, an enhanced vapor injection electronic expansion valve, a memory, a processor and a heating control program of the air conditioner stored in the memory and executable by the processor, so as to divide refrigerant passing through the evaporator into two flows through the shunting module, when the heating control program of the air conditioner is executed by the processor, the operations of the heating control method of the air conditioner of the above embodiments are realized.

The present application further provides a computer readable storage medium, the computer readable storage medium includes a heating control program of an air conditioner, when the heating control program of the air conditioner is executed by the processor, the operations of the heating control method of the air conditioner of the above embodiments are realized The serial numbers of the embodiments of the present application are only for description, and do not represent the superiority or inferior of the embodiments.

It should be noted that the terms "comprising", "including" or any other variation thereof herein are intended to cover a non-exclusive inclusion, such that a process, method, article, or system that includes a series of elements not only includes those elements, but also includes other elements not expressly listed, or an element inherent to such a process, method, article, or system. In the absence of more restrictions, an element defined by the phrase "comprising one . . . " does not exclude the presence of additional identical elements in the process, method, article, or system that includes the element.

Through the description of the above embodiments, a person skilled in the art can clearly understand that the method can be implemented by means of software plus a necessary universal hardware platform, of course, can also be implemented by hardware, but in many cases, the former is preferred. Based on such an understanding, the technical solution of the present application essentially or the part giving a contribution to the prior art may be embodied in the form of a software product, and the computer software product is stored in a computer readable storage medium (such as a ROM/RAM, a magnetic disk, or an optical disk) as described above, and includes several instructions for enabling a terminal (which may be a mobile phone, a computer, a server, an air conditioner, or a network air conditioner, or the like) to execute the method according to various embodiments of the present application.

The above are only preferred embodiments of the present application, and is not therefore intended to limit the scope of the present application. Any equivalent structure or equivalent process transformation made using the description and drawings of the present application, or any direct or indirect application to other related technical fields, is included in the claimed scope of the present application.

What is claimed is:

1. A heating control method of an air conditioner applied to a heating control system of the air conditioner, the heating control system comprising a shunt and an enhanced vapor injection electronic expansion valve, the shunt dividing refrigerant passing through an evaporator into a first flow and a second flow, the first flow being subject to throttling and depressurizing through the enhanced vapor injection electronic expansion valve, the heating control method comprising:

acquiring a current indoor temperature, and calculating a first difference between the current indoor temperature and a preset temperature;

when the first difference is greater than a first temperature threshold, acquiring an indoor pipe temperature of the evaporator and an exhaust temperature of a compressor, and calculating a second difference between the indoor pipe temperature and the exhaust temperature;

determining an opening degree parameter of the enhanced vapor injection electronic expansion valve based on the second difference, to control a refrigerant output amount by the enhanced vapor injection electronic expansion valve, and throttling and depressurizing a part of the first flow of the refrigerant through the enhanced vapor injection electronic expansion valve based on the refrigerant output amount; and carrying out heat exchange between the part of the first flow of the refrigerant and the second flow of the refrigerant to generate heat, thereby increasing a heating amount of the air conditioner.

2. The heating control method according to claim 1, wherein the determining the opening degree parameter of the enhanced vapor injection electronic expansion valve based on the second difference, to control the refrigerant output amount by the enhanced vapor injection electronic expansion valve, and the throttling and depressurizing a part of the first flow of the refrigerant through the enhanced vapor injection electronic expansion valve comprises:

determining whether the second difference is not less than a first threshold; and if the second difference is not less than the first threshold, increasing the opening degree parameter of the enhanced vapor injection electronic expansion valve to increase the refrigerant output amount by the enhanced vapor injection electronic expansion valve, and throttling and depressurizing the part of the first flow of the refrigerant through the enhanced vapor injection electronic expansion valve.

3. The heating control method according to claim 2, wherein the increasing the opening degree parameter of the enhanced vapor injection electronic expansion valve comprises:

according to a preset time interval, controlling the opening degree parameter of the enhanced vapor injection electronic expansion valve to increase a fixed value each time and increase to a maximum opening degree parameter.

4. The heating control method according to claim 2, wherein the determining whether the second difference is not less than the first threshold comprises:

if the second difference is less than the first threshold, determining whether the second difference is less than a second threshold, wherein the second threshold is less than the first threshold; and if the second difference is less than the second threshold, reducing the opening degree parameter of the enhanced vapor injection electronic expansion valve, to decrease the refrigerant output amount by the enhanced vapor injection electronic expansion valve, and throttling and depressurizing the part of the first flow of the refrigerant through the enhanced vapor injection electronic expansion valve.

5. The heating control method according to claim 4, wherein after the determining whether the second difference is less than the second threshold if the second difference is less than the first threshold, the heating control method further comprises:

if the second difference is less than the first threshold but not less than the second threshold, controlling the enhanced vapor injection electronic expansion valve to maintain a current opening degree parameter, to maintain a current refrigerant output amount by the enhanced vapor injection electronic expansion valve, and throttling and depressurizing the part of the first flow of the refrigerant through the enhanced vapor injection electronic expansion valve based on the current refrigerant output amount.

6. The heating control method according to claim 1, wherein after the acquiring the current indoor temperature, and calculating the first difference between the current indoor temperature and the preset temperature, the heating control method further comprises:

when the first difference is not greater than the first temperature threshold and not less than a second temperature threshold, determining whether the second difference is not less than the first temperature threshold, wherein the second temperature threshold is less than the first temperature threshold; and if the second difference is not less than the first temperature threshold, controlling the enhanced vapor injection electronic expansion valve to maintain a current opening degree parameter, to maintain a current refrigerant output amount by the enhanced vapor injection electronic expansion valve, and throttling and depressurizing the part of the first flow of the refrigerant through the enhanced vapor injection electronic expansion valve based on the current refrigerant output amount.

7. The heating control method according to claim 6, wherein after the determining whether the second difference is not less than the first temperature threshold when the first difference is not greater than the first temperature threshold and not less than a second temperature threshold, the heating control method further comprises:

if the second difference is less than both the first temperature threshold and the second temperature threshold which is less than the first temperature threshold, reducing the opening degree parameter of the enhanced vapor injection electronic expansion valve, to reduce the refrigerant output amount by the enhanced vapor injection electronic expansion valve, and throttling and depressurizing the part of the first flow of the refrigerant through the enhanced vapor injection electronic expansion valve based on the reduced refrigerant output amount; and if the second difference is less than the first temperature threshold but not less than the second temperature threshold, controlling the enhanced vapor injection electronic expansion valve to maintain the current opening degree parameter, to maintain the current refrigerant output amount by the enhanced vapor injection electronic expansion valve, and throttling and depressurizing the part of the first flow of the refrigerant through the enhanced vapor injection electronic expansion valve based on the current refrigerant output amount.

8. The heating control method of according to claim 1, wherein after the acquiring the current indoor temperature, and calculating the first difference between the current indoor temperature and the preset temperature, the heating control method further comprises:

when the first difference is less than the second temperature threshold and greater than a third temperature threshold, closing the enhanced vapor injection electronic expansion valve, and reducing a working frequency of the compressor.

9. An air conditioner comprising: a shunt, an enhanced vapor injection electronic expansion valve, a memory, a hardware processor, and a heating control program for the air conditioner stored in the memory and executable by the hardware processor to implement the heating control method of claim 1.

10. A non-transitory computer-readable storage medium storing a program that causes a hardware processor of an air conditioner to execute the heating control method of claim 1.

* * * * *